US005996153A

United States Patent [19]

Slater et al.

[11] Patent Number: 5,996,153

[45] Date of Patent: Dec. 7, 1999

[54] INFANT TORSO SUPPORT DEVICE

[75] Inventors: Amy L. Slater, 15016 SE. Diamond Dr., Clackamas, Oreg. 97015; Karla M. Hubbell, Gresham, Oreg.

[73] Assignee: Amy L. Slater, Henderson, Nev.

[21] Appl. No.: 09/025,810

[22] Filed: Feb. 19, 1998

[51] Int. Cl.[6] ..... A47C 20/02

[52] U.S. Cl. ..... 5/655; 5/652; 5/484; 5/922

[58] Field of Search ..... 5/655, 484, 494, 5/652, 657, 922; 604/391

[56] References Cited

U.S. PATENT DOCUMENTS 3,496,928 2/1970 Piccolo .
3,788,699 1/1974 Starr .
4,383,713 5/1983 Roston .
4,862,535 9/1989 Roberts .
5,019,073 5/1991 Roessler et al. ..... 604/391
5,066,289 11/1991 Polski ..... 604/391 X
5,095,567 3/1992 Kenoyer .
5,547,250 8/1996 Childers .
5,551,749 9/1996 Reher et al. .
5,611,095 3/1997 Schneider .
5,678,888 10/1997 Sowell et al. .

*Primary Examiner*—Terry Lee Melius
*Assistant Examiner*—Rodrigo J. Morales
*Attorney, Agent, or Firm*—Tipton L. Randall

[57] ABSTRACT

A torso support device for an infant comprises an I-shaped padded member that fits between an infant's legs and is secured by fasteners around the infant's torso to support the infant in a sitting position.

6 Claims, 7 Drawing Sheets

INFANT TORSO SUPPORT DEVICE

FIELD OF THE INVENTION

This invention relates to an infant torso support device, and more particularly to a support device to maintain an infant in an upright position in various seating systems.

BACKGROUND OF THE INVENTION

As an infant develops with age, the child is able to sit upright for short periods of time. To assist the infant in sitting upright, the child is often placed in a support device such as a high chair, a swing, a walker, a grocery cart or the like that has leg openings and some form of back and/or front support. Often these support devices are oversized and the infant will slip to one side or the other, ending up in an uncomfortable or even dangerous position. To secure the infant in these oversized support devices, various packing materials such as diapers, blankets or pillows are stuffed around the child to wedge them in the device. These packing materials are generally unsatisfactory and do not stay in position.

A number of patents concerned with support cushions for infants are known. In U.S. Pat. No. 5,095,567 issued Mar. 17, 1992, Kenoyer discloses a baby back support device to aid in learning to sit. The device straps about the infant's buttocks with a strap across the lap.

A cushioned seating device for use by infants in shopping carts is described by Childers in U.S. Pat. No. 5,547,250 issued Aug. 20, 1996. The device fastens around the infant's torso.

In U.S. Pat. No. 5,551,749 issued Sep. 3, 1996, Reher et al. disclose an infant support seat and cushion combination.

Sowell et al., in U.S. Pat. No. 5,678,888 issued Oct. 21, 1997, describe a seat cover which conforms to a shopping cart to protect children riding therein.

Thus, it is an objective of the invention to provide secure support for an infant in a seating device. It is also an objective to provide a device that fits over the clothing and diapers of an infant, a device that is resistant to body fluids, and that is easy to put on and take off an infant.

Consequently, there is an unmet need for an infant torso support device that will securely hold an infant in an upright position in a highchair, swing, grocery cart, walker or similar device.

SUMMARY OF THE INVENTION

The invention is a torso support device for infants comprising an I-shaped padding member including a first padded horizontal end portion with center section and first and second end sections, and a second padded horizontal end portion with center section and first and second end sections. A vertical connecting portion is connected between the center sections of the first and second horizontal portions. A fastening means for reversibly connecting both first end sections together and for reversibly connecting both second end sections together is present. The supporting device is secured to an infant with the connecting portion positioned between an infant's legs, with the first and second end portions encircling an infant's torso, and the end portions fastened around the infant's torso by the fastening means. Also disclosed is a method of using and a method of making an infant torso support device.

DESCRIPTION OF THE PREFERRED EMBODIMENT

Nomenclature

10 I-Shaped Padding Member
20 First Horizontal End Portion
21 First End Section
22 Second End Section
23 Center Section
30 Second Horizontal End Portion
31 First End Section
32 Second End Section
33 Center Section
40 Vertical Center Portion
50 Fastening Means
51 Loop and Hook Fastener
52 Loop and Hook Fastener
53 Loop and Hook Fastener
54 Loop and Hook Fastener

Construction

Figure 1:
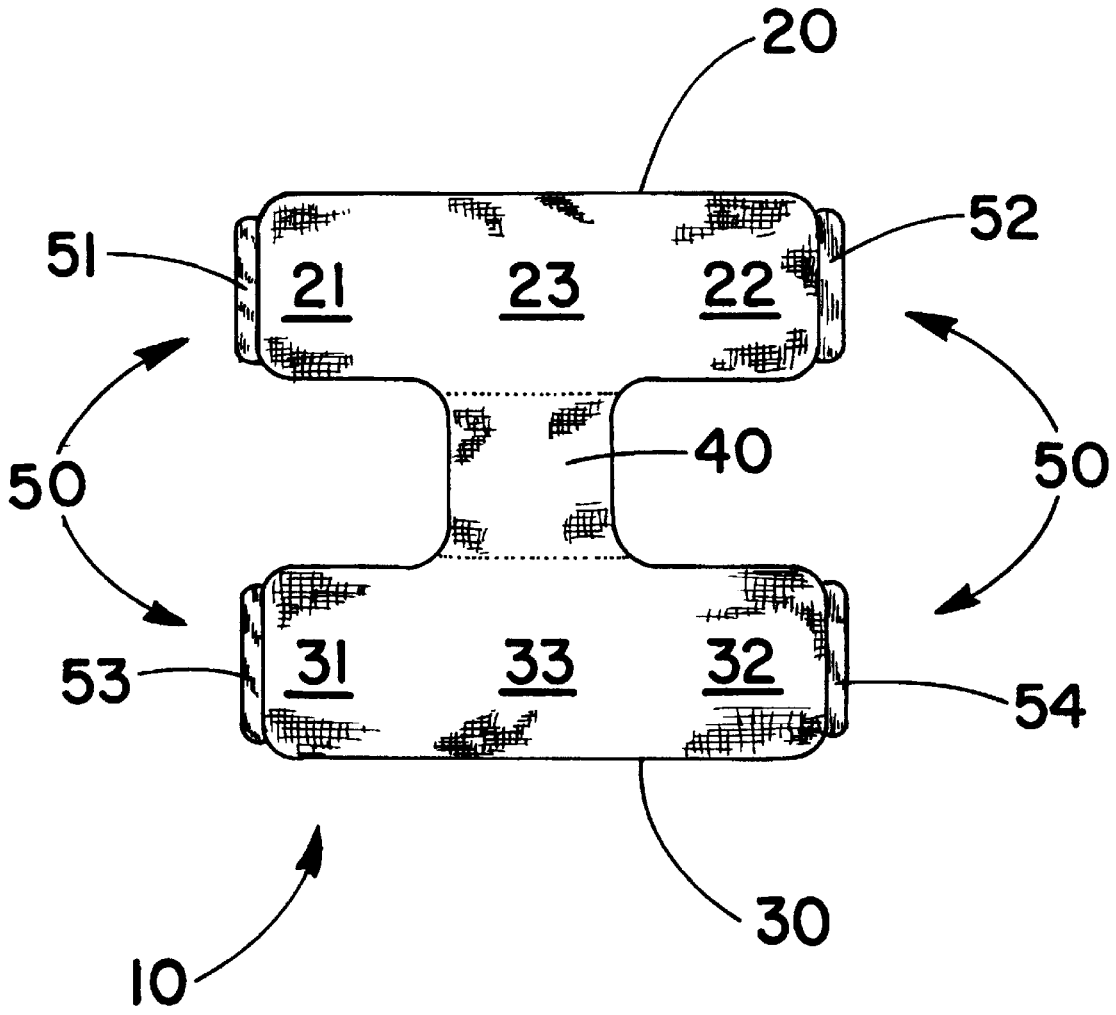
FIG. 1 is a top plan view of the torso support device of the present invention.

Referring to FIG. 1 the torso support device for infants is shown. The device comprises an I-shaped padding member 10 that includes first and second horizontal end portions 20, 30. Each end portion is composed of first end sections 21, 31 second end sections 22, 32 and center sections 23, 33. A vertical center portion 40 connects the center sections 23, 33. The four end sections 21, 22, 31, 32 of the horizontal end portions 20, 30 each has fastening means 50 attached thereto. Preferably the fastening means 50 are portions of hook and loop fastener tape, 51, 52, 53, 54, secured as flaps on the four end sections.

Figure 2:
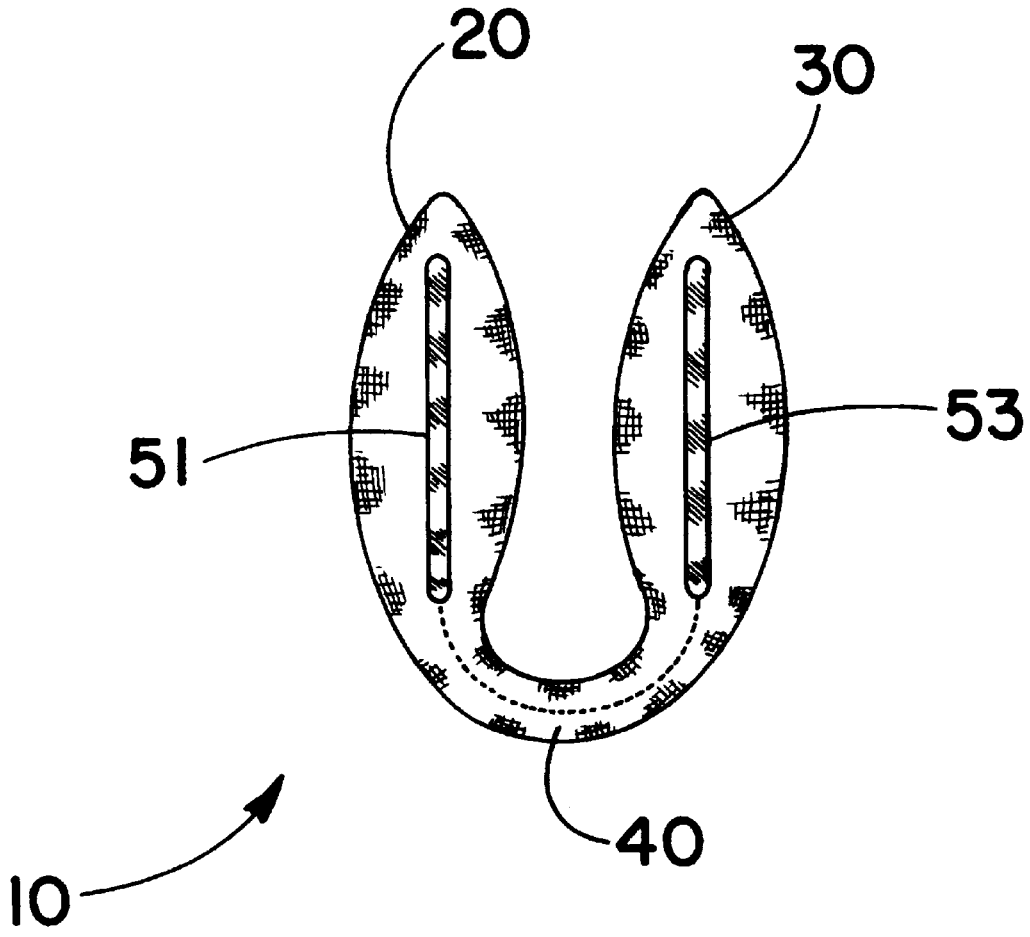
FIG. 2 is a perspective side view of the torso support device folded in preparation for applying the device to an infant.

The torso support device is fabricated from two I-shaped sheets fastened together at their perimeter. The sheets are preferably a waterproof material, such as plastic, rubber or the like, to withstand body fluids. The two horizontal end portions 20, 30 contain padding material, such as natural or synthetic fibers that are commercially available, while the vertical connection portion 40 contains little or no padding material. It may be desirable to segregate the padding material to the two horizontal end portions 20, 30 by stitching between the two sheets along the intersection with the vertical connecting portion 40, as shown in FIG. 1. The vertical connection portion 40 is sufficiently pliable that it allows the two horizontal end portions 20, 30 to be oriented in opposition to each other, as shown in FIG. 2. A strip of hook and loop fastener tape, 51–54, is secured as a flap to each end of the horizontal end portions 20, 30. The hook and loop fastener tape can be connected to the end portions when the two I-shaped sheets are fastened together at their perimeter.

The torso support device is secured to an infant with the non-padded vertical connecting portion 40 between the child's legs and the first and second end portions 20, 30 encircling the infant's lower torso by connecting the fasteners on the first ends 21, 31 of the end portions 20, 30 and then connecting the fasteners on the second ends 22, 32 of the end portions. It is understood that to effect connections, one strip of fastener is a loop strip and the other strip of fastener is the hook strip.

Figure 3:
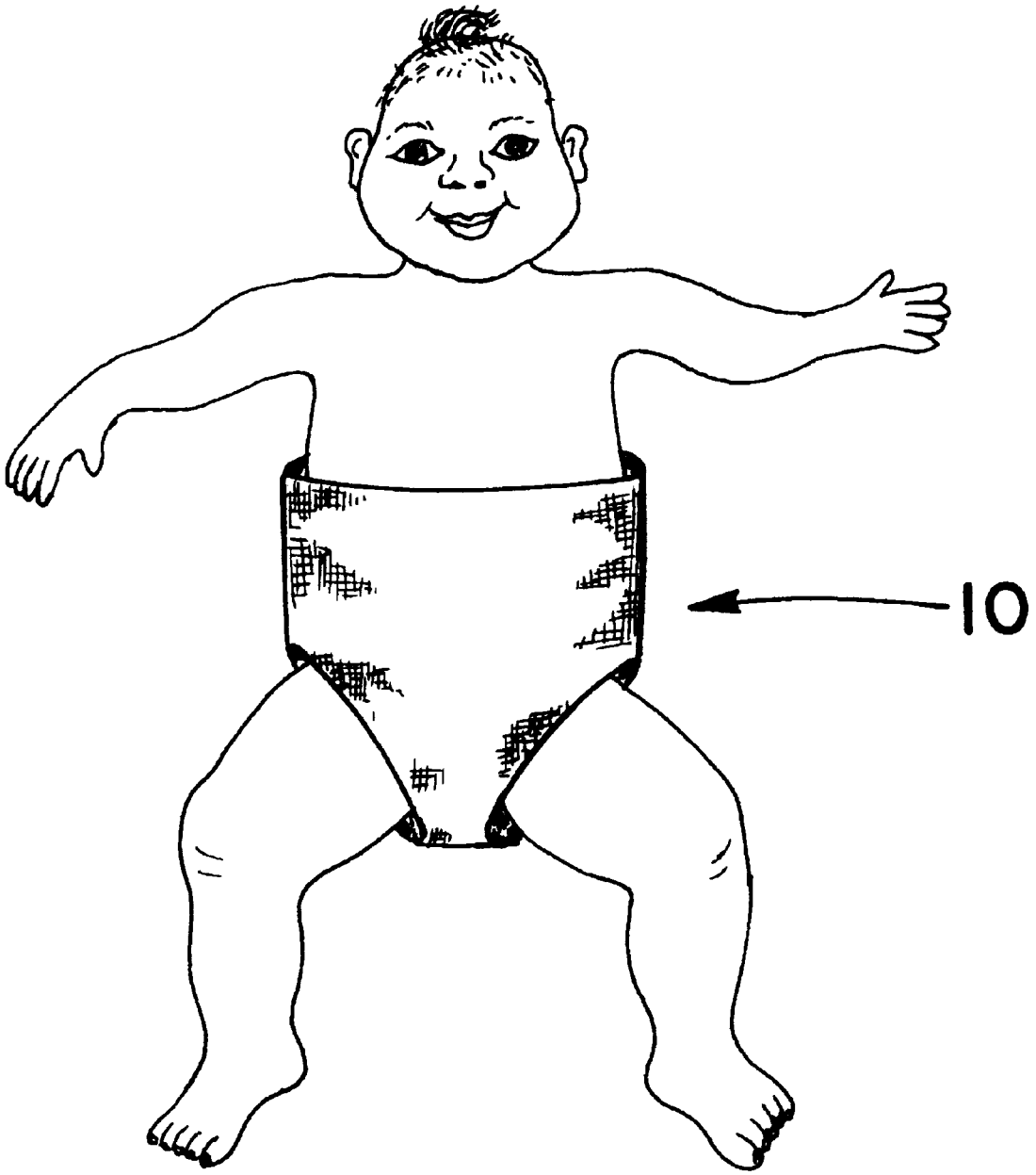
FIG. 3 is a perspective view of the torso support device secured to an infant.

The torso support device of the present invention is shown secured to an infant in FIG. 3. Thus, the infant fitted with the support device can be placed in a sitting device, such as a highchair, a walker, a swing, a grocery cart or the like, with the torso support device occupying any extra space between the infant and the sitting device, to hold the infant in a comfortable position. A seen in FIG. 3, the support device is sized to extend up and encircle the infant's torso, nearly under the infant's arms. This provides additional stability for the infant secured therein. The torso support device may be manufactured in a variety of sizes to accommodate the infant as normal growth occurs. Other fastener means for securing the ends of the support device together are contemplated, including strings, ropes, elastic bands, buttons, snaps, zippers or hooks. The hook and loop fasteners are the preferred fastener means due to the adjustability these fasteners provide.

Figure 4:
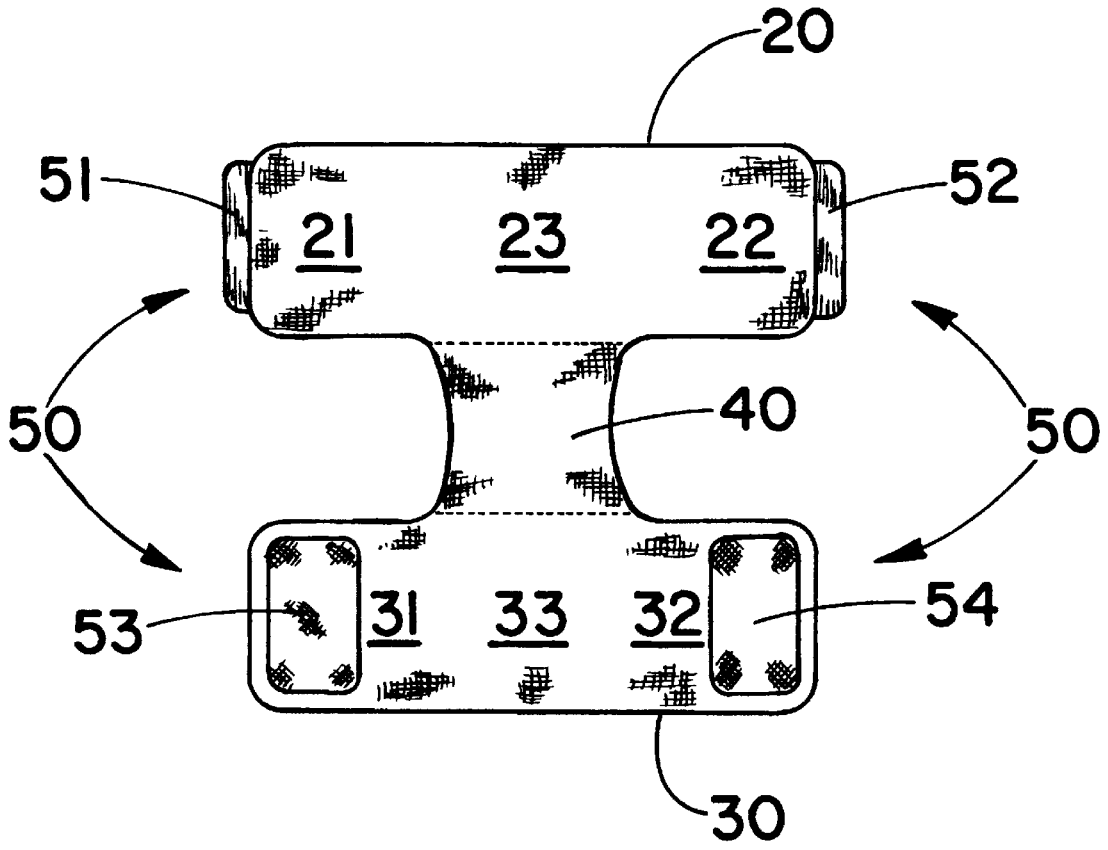
FIG. 4 is a top plan view of an alternative embodiment of the torso support device of the present invention.
Figure 5A:
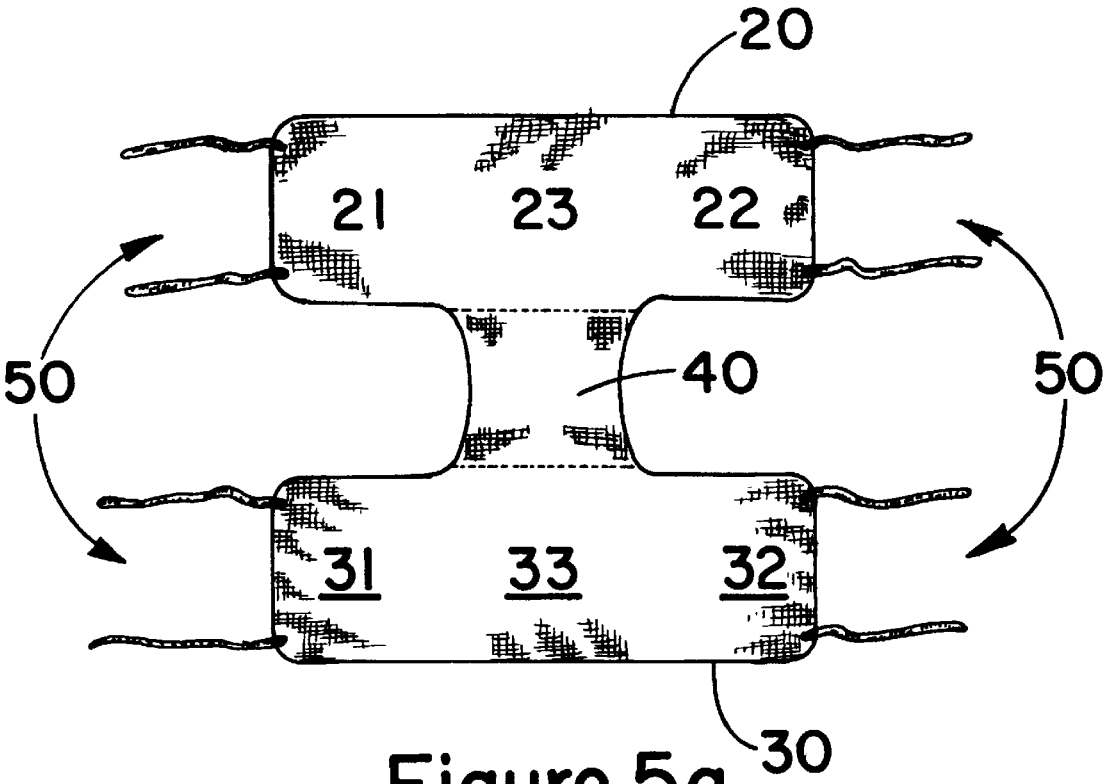
FIGS. 5*a*, 5*b*, 5*c*, and 5*d* are top plan views of alternative embodiments of the torso support device of the present invention.
Figure 5B:
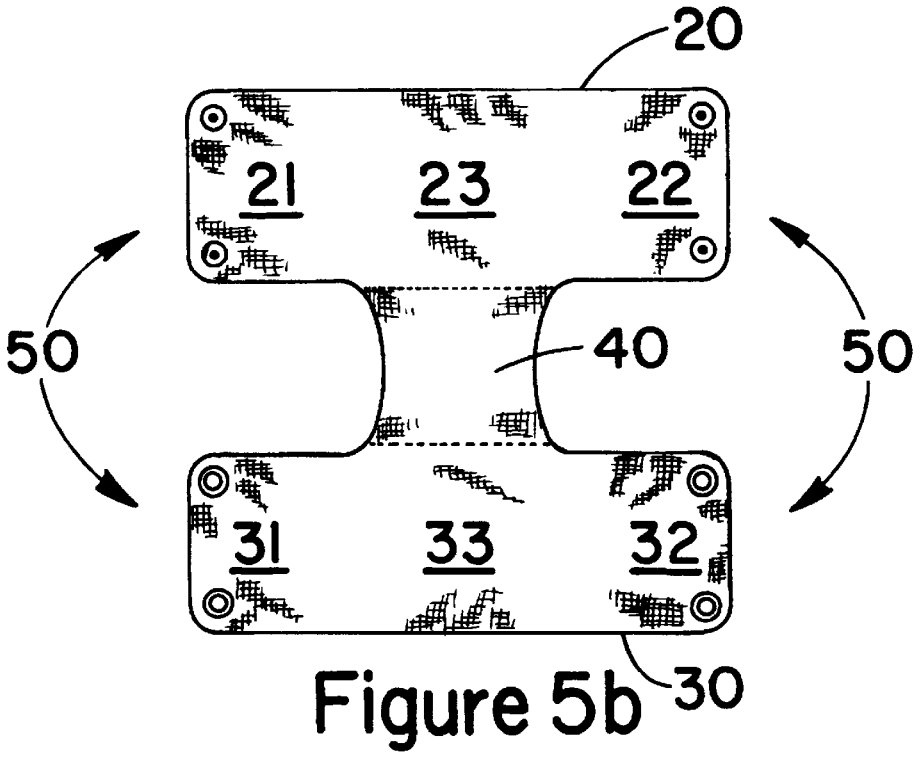
Figure 5C:
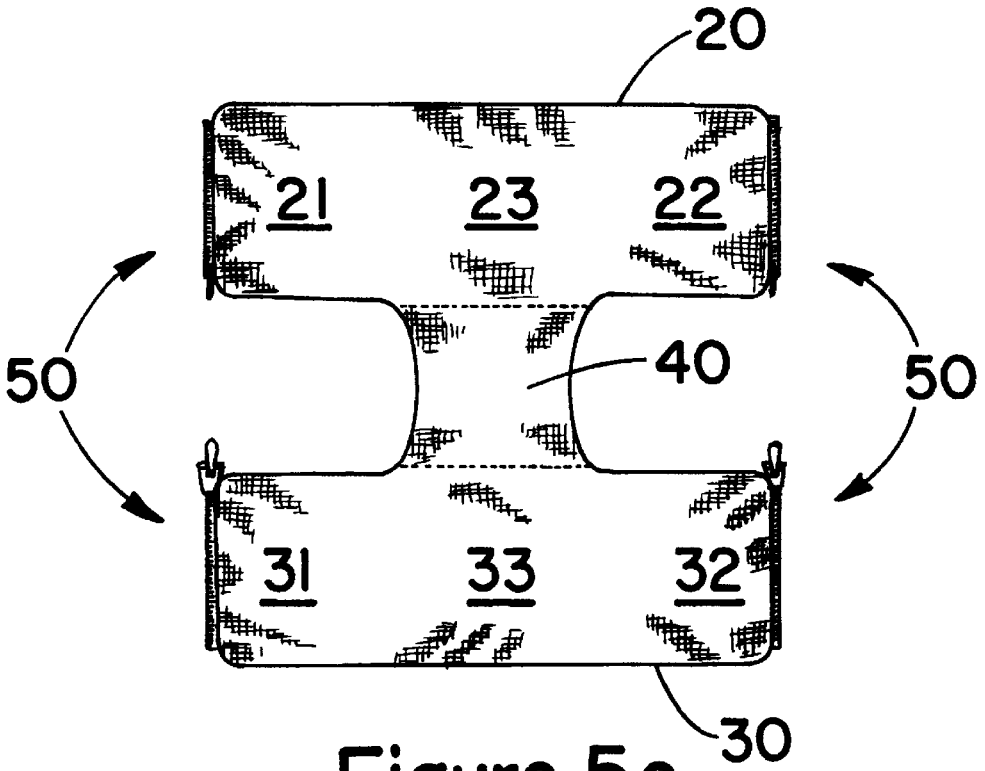
Figure 5D:
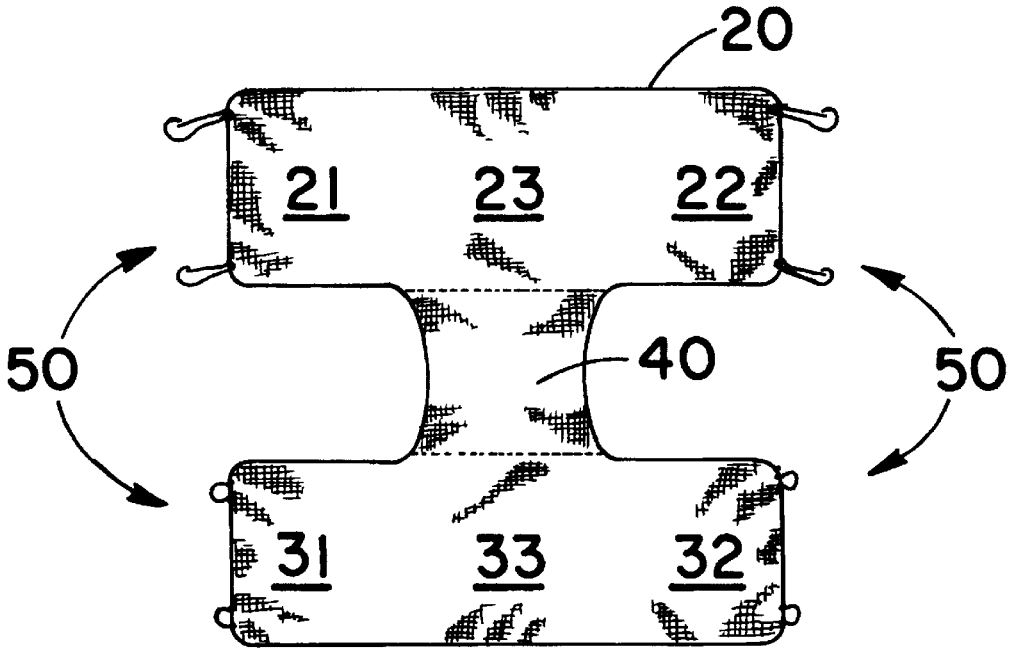
Figure 6:
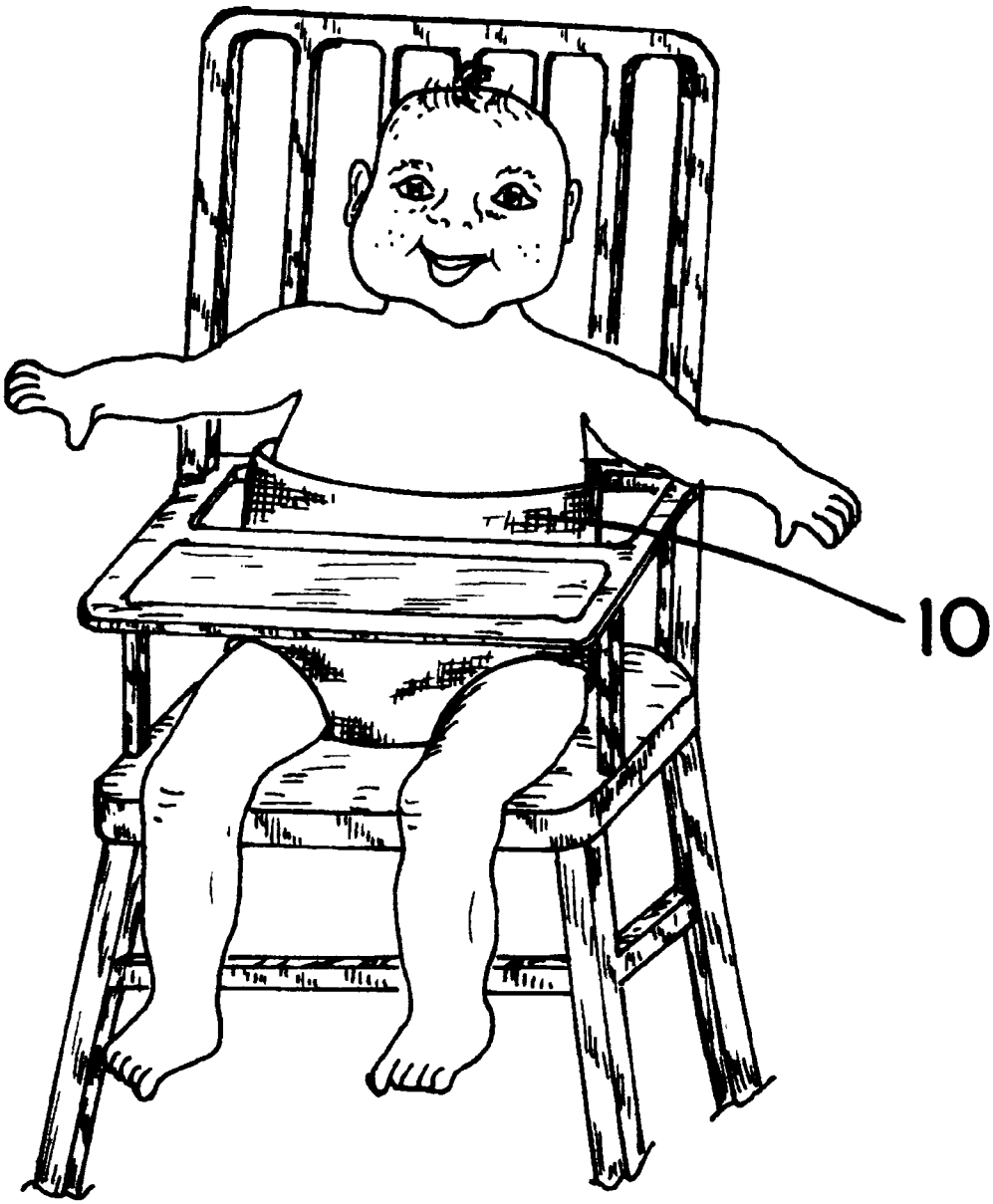
FIG. 6 is a perspective view of an infant wearing the torso support device and positioned in a seating device.

An alternative embodiment of the present invention is shown in FIG. 4. The hook and loop fastener flaps on one horizontal end portion are secured to the surface of that end portion rather than at the edge thereof. This configuration of the fastening means allows for greater adjustability in size of the torso support device to accommodate different sized infants.

The invention also includes method of supporting an infant in a seating device. The method comprises providing an I-shaped padding member including a first padded horizontal end portion with center section and first and second end sections, a second padded horizontal end portion with center section and first and second end sections, a vertical connecting portion between said first and second horizontal portions center sections, and fastening means for reversibly connecting both first end sections together and for reversibly connecting both second end sections together. The I-shaped padding member is secured to an infant with the connecting portion positioned between an infant's legs. The first and second end portions encircle an infant's torso, with end portions fastened there around by the fastening means. An infant wearing the I-shaped padding member is positioned in a seating device.

A method of making an infant torso support device comprising obtaining two sheets of I-shaped material each with first and second horizontal end portions and a vertical connecting portion. The two I-shaped sheets with first and second horizontal end portions and vertical connecting portions in register are fastened peripherally together to form an interior cavity. The cavity contains a padding material between each pair of horizontal end portions. Fastening means is secured to the connected horizontal end portions to allow the I-shaped padding support member to be fastened around an infant's torso.

While the invention has been particularly shown and described with reference to a preferred embodiment thereof, it will be understood by those skilled in the art that various changes in form and details may be made therein without departing from the spirit and scope of the invention.

We claim:

1. A torso support device for infants comprising an I-shaped padding member comprising;

(a) a first padded horizontal end portion with center section and first and second end sections;

(b) a second padded horizontal end portion with center section and first and second end sections;

(c) an unpadded vertical connecting portion between said first and second horizontal portions center sections;

(d) first and second I-shaped liquid impervious sheet members enclosing said first and second padded horizontal end portions and said vertical connecting portion there between, said liquid impervious sheet members peripherally fastened together, thereby producing liquid impervious first and second padded horizontal end portions and liquid impervious vertical connecting portion; and (e) fastening means for reversibly connecting both first end sections together and for reversibly connecting both second end sections together, whereby said liquid impervious supporting device is for securing to an infant with said liquid impervious, unpadded connecting portion positioned between the infant's legs, with said first and second liquid impervious end portions encircling the infant's torso, said end portions fastened there around by said fastening means.

2. A torso support device according to claim 1 wherein said fastening means is selected from a group consisting of snaps, hooks, zippers, rope ties and hook and loop fasteners.

3. A torso support device according to claim 1 wherein said fastening means is hook and loop fasteners.

4. A torso support device according to claim 3 wherein said hook and loop fasteners are flaps secured peripherally to said first and second liquid impervious end sections of said first and second horizontal end portions.

5. A torso support device according to claim 3 wherein half of said hook and loop fasteners are flaps secured peripherally to said first and second liquid impervious end sections of one horizontal end portion, and half of said hook and loop fasteners are patches secured to a surface of said first and second liquid impervious end sections of another horizontal end portion.

6. A method of supporting an infant in a seating device comprising;

(a) providing a liquid impervious I-shaped padding member including a first padded horizontal end portion with center section and first and second end sections, a second padded horizontal end portion with center section and first and second end sections, an unpadded vertical connecting portion between said first and second horizontal portions center sections, first and second I-shaped liquid impervious sheet members enclosing said first and second padded horizontal end portions and said vertical connecting portion there between, said liquid impervious sheet members peripherally fastened together, thereby producing liquid impervious first and second padded horizontal end portions and liquid impervious vertical connecting portion, and fastening means for reversibly connecting both first end sections together and for reversibly connecting both second end sections together;

(b) securing said liquid impervious I-shaped padding member to an infant with said liquid impervious, unpadded connecting portion positioned between the infant's legs, with said first and second liquid impervious end portions encircling the infant's torso, said end portions fastened there around by said fastening means; and (c) positioning the infant wearing said I-shaped padding member in a seating device.

* * * * *